109-84 SR
3/18/80 XR 4,193,353

United States Patent [19]
Hinton et al.

[11] 4,193,353
[45] Mar. 18, 1980

[54] SECURITY STORAGE BOX

[75] Inventors: Arthur D. Hinton; Morris E. Mitchell, both of Fayetteville, Ark.

[73] Assignee: Steel Security Corporation, Fayetteville, Ark.

[21] Appl. No.: 877,343

[22] Filed: Feb. 13, 1978

[51] Int. Cl.[2] ..... E05G 1/024; E05G 1/04; E05C 19/18

[52] U.S. Cl. ..... 109/50; 109/57; 109/59 R; 109/84; 292/288; 292/302

[58] Field of Search ..... 109/50, 57, 58, 59, 109/64, 84; 292/302, DIG. 9, 288

[56] References Cited

U.S. PATENT DOCUMENTS

| | | | |
|---|---|---|---|
| 552,517 | 1/1896 | Davis | 109/84 X |
| 770,142 | 9/1904 | Wood | 109/50 |
| 1,606,151 | 11/1926 | Dahnke | 109/84 X |
| 1,644,410 | 10/1927 | Belknap | 109/50 |
| 4,043,279 | 8/1977 | Padgett | 109/50 |
| 4,058,993 | 11/1977 | Stubbings | 292/302 X |

FOREIGN PATENT DOCUMENTS

| | | | |
|---|---|---|---|
| 998880 | 1/1952 | France | 109/50 |

*Primary Examiner*—David H. Corbin
*Attorney, Agent, or Firm*—Head & Johnson

[57] ABSTRACT

A security storage box comprising a housing having the walls thereof insulated or otherwise protected to provide a substantially fireproof and heat resistant internal storage area for receiving a container or the like therein, the housing being adapted for installation in a concealed place for security against theft of the contents thereof, said housing being provided with a cover for facilitating access to the internal storage area, and a pin-lock device cooperating between the cover and the housing operable only by a particularly designed key for cooperation with the pin member to unauthorized preclude opening of the storage box.

13 Claims, 15 Drawing Figures

SECURITY STORAGE BOX

BACKGROUND OF THE INVENTION

1. Field of the Invention

This invention relates to improvements in storage boxes and more particularly, but not by way of limitation, to a concealed, substantially fireproof, heat proof, and theft proof security storage box.

2. Description of the Prior Art

It is frequently desirable to store valuable items, such as important documents, articles which are unreplacable or valuable or otherwise endeared to the owner thereof, and the like. Many persons who own or are in custody of such articles are hard pressed to find a storage place for the items which is secure from theft, and safe from the hazards of fire, heat and the like. Home-type or portable storage boxes are available, many of which are termed "fireproof", but these devices are normally provided with a standard key type lock which is frequently of a type easily opened by a thief. As an alternate solution to the problem, wall safes, and the like, are also available for home installation, or the like, but these safes are normally provided with combination-type locks, and these are also usually easily opened by unscrupulous persons. Another solution to the problem is the use of the well known safety deposit boxes, but these are normally located in a bank vault, or the like, and are normally accessible only during banking hours. Furthermore, in the event of the death of a holder of a safety deposit box, the contents of the box are usually not readily available to survivors, or the like.

SUMMARY OF THE INVENTION

The present invention contemplates a novel security storage box particularly designed and constructed for overcoming the foregoing disadvantages. The security box comprises a housing which in one embodiment is double walled and having a suitable insulation material, interposed between the walls for providing an internal chamber substantially secure from the hazards of fire and heat. A lock box or container of any suitable type may be removably disposed in the chamber for storage in a manner for protection of the contents thereof from theft and fire. A cover or lid is provided for the storage box for facilitating access to the internal chamber, and is provided with a pin-lock device cooperating between the cover and housing for security locking of the storage box for protection against theft. The pin-lock device may be released only through the use of a specially designed key and pin arrangement, and since the internal structure of the pin-lock device is concealed by the structure of the storage box housing, it is substantially impossible to remove the lid from the box without the particularly designed key which is constructed for the particular lock. In addition, the housing is particularly designed for installation in a concealed place, such as between a pair of adjacent joints in a floor. The upper portion of the housing is preferably recessed with respect to the surrounding floor surface, in this type installation and may be covered with a section of flooring, or the like, in such a manner that the presence of the installed storage box is undiscernable. This concealed type installation in combination with the theft-proof pin-lock device and the fire and heat resistant construction of the box provides an efficient storage box for valuables.

DESCRIPTION OF THE PREFERRED EMBODIMENTS

Figure 1:
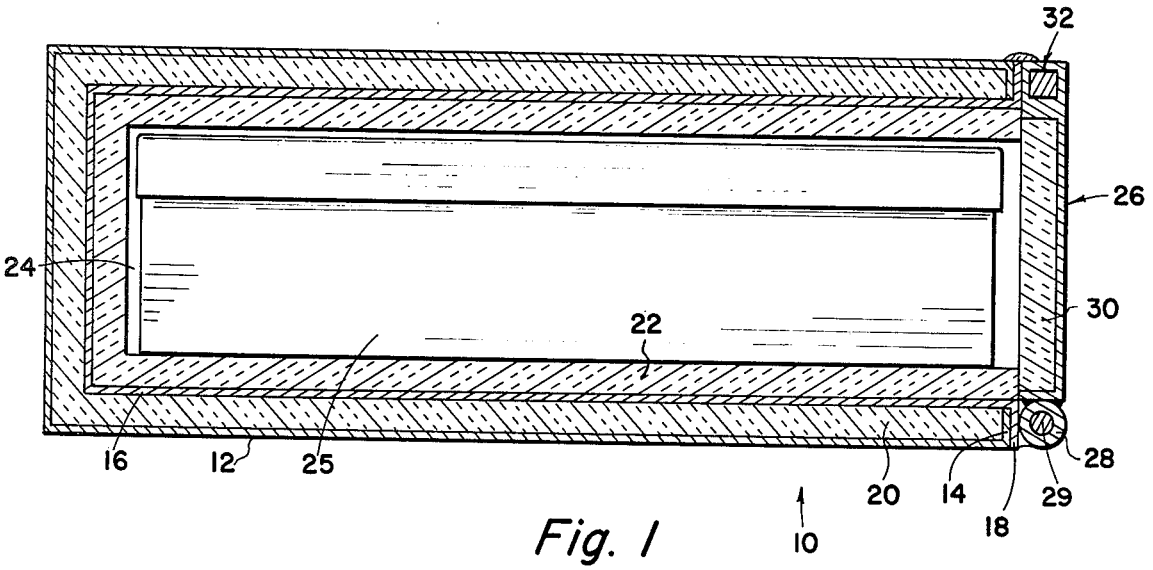
FIG. 1 is a sectional elevational view of a security storage box embodying the invention, and illustrating a container stored therein.
Figure 2:
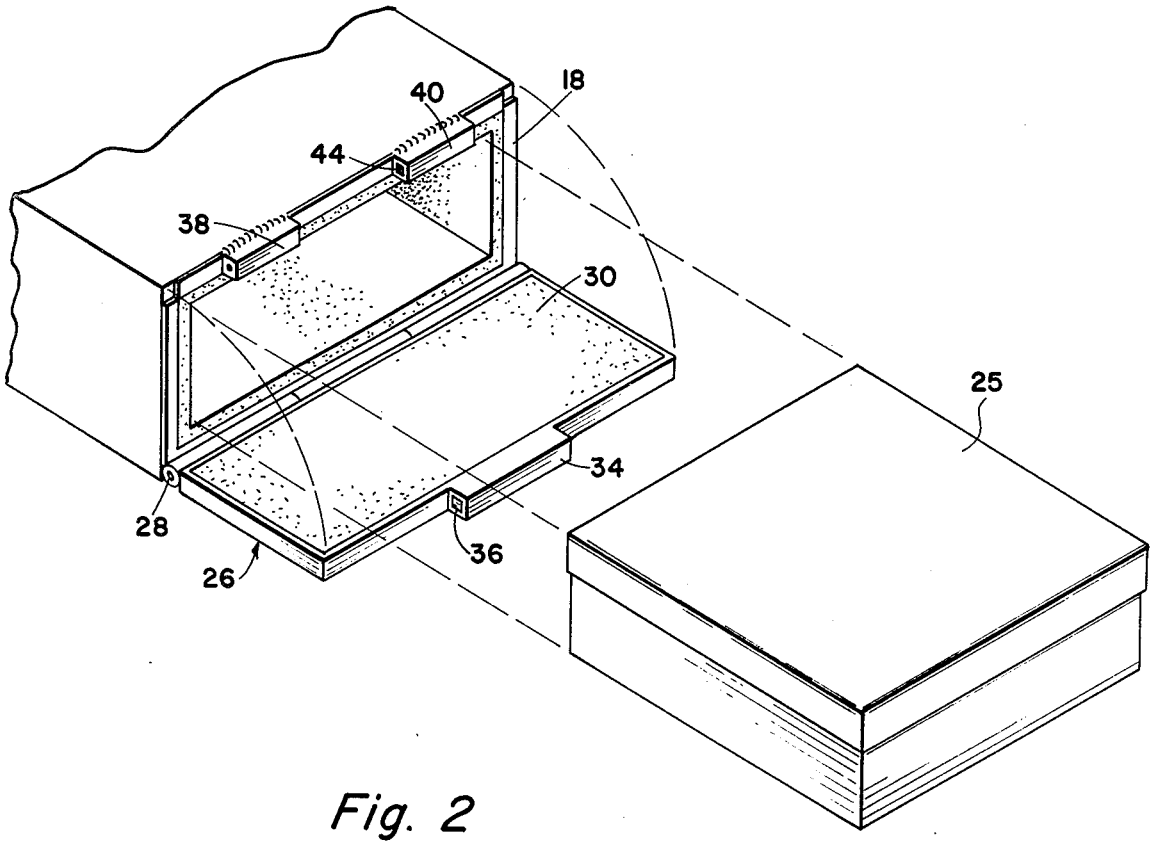
FIG. 2 is a perspective view of one end of the security storage box shown in FIG. 1, with the access door open and the container separate therefrom.
Figure 3:
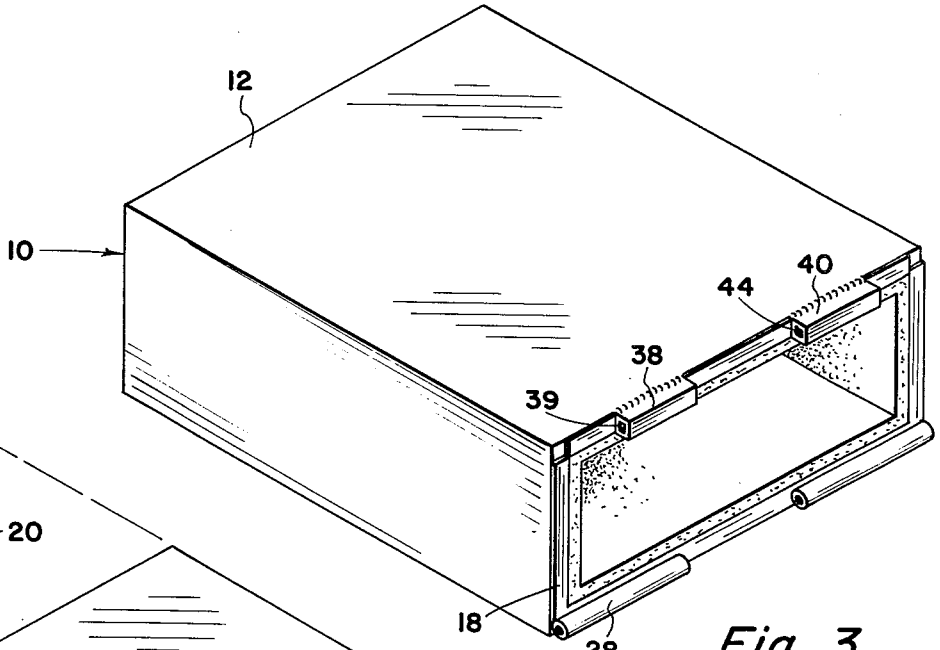
FIG. 3 is a perspective view of the security storage box shown in FIGS. 1 and 2 with the access door thereof removed for purposes of illustration.
Figure 4:
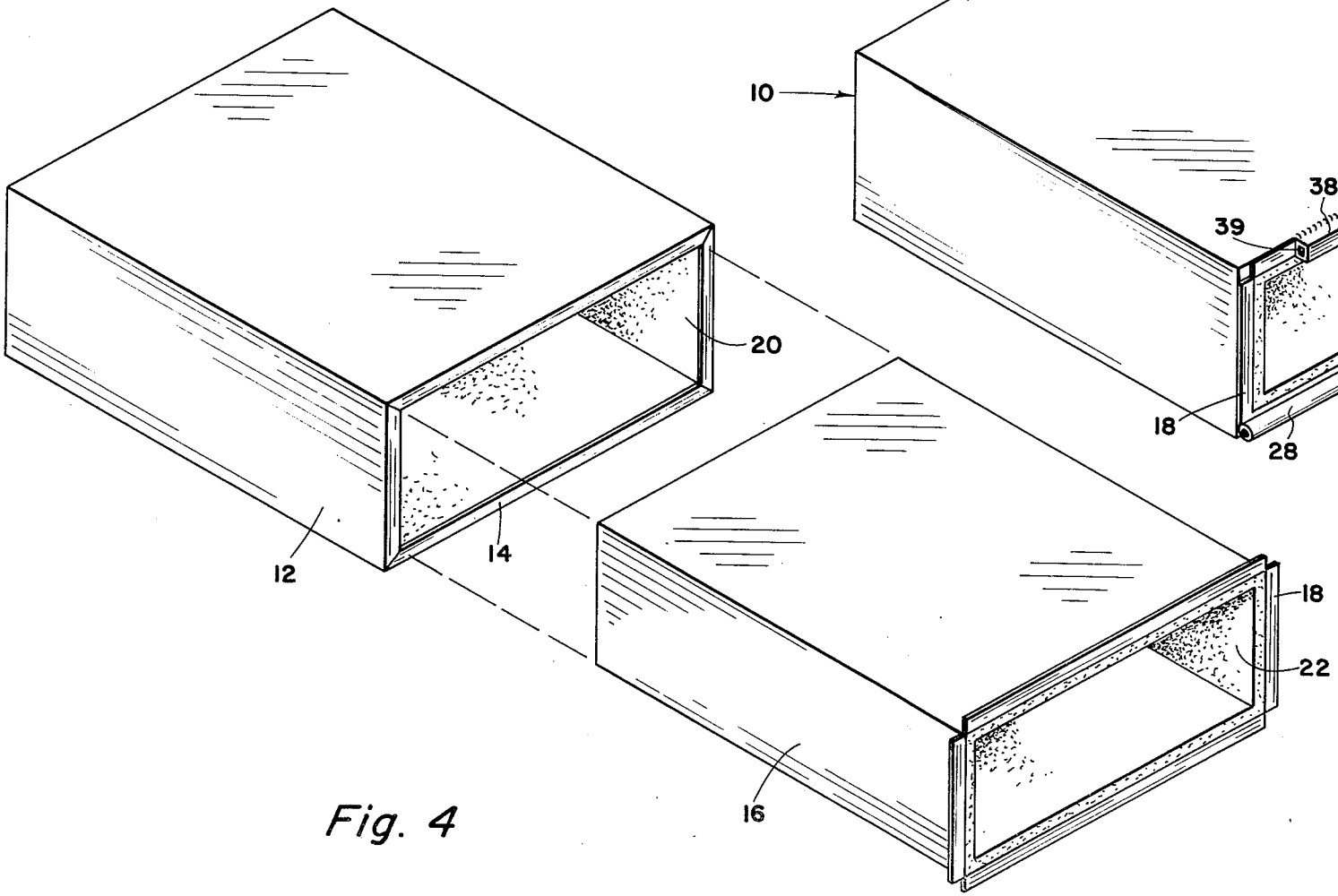
FIG. 4 is a perspective view of the storage box shown in FIG. 3 and particularly illustrates the relationship between the inner and outer housing elements thereof.
Figure 5:
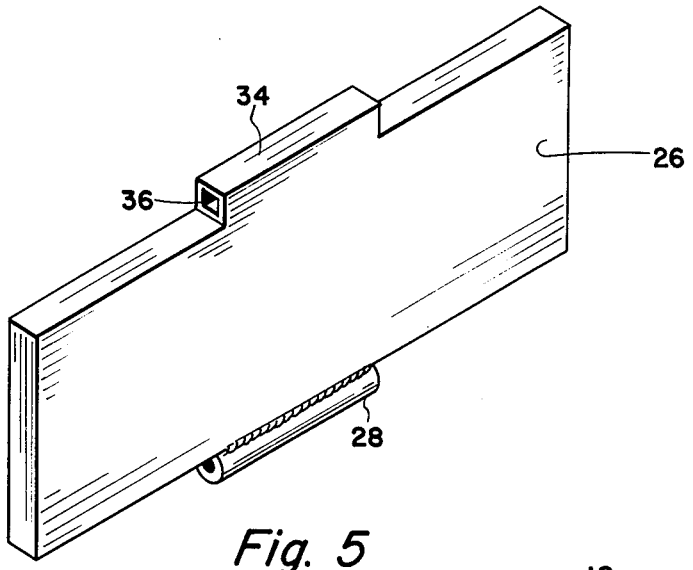
FIG. 5 is a perspective view of the access door of the storage box shown in FIGS. 1 through 4.

Referring to the drawings in detail, and particularly FIGS. 1 through 8, reference character 10 generally indicates a security storage box comprising an outer housing 12 constructed of a suitable fire and heat resistant material, such as steel, and preferably having a substantially rectangular cross-sectional configuration, but not limited thereto. At least one end or side of the housing 12 is open, and is provided with an inwardly directed flange 14 around the inner periphery thereof. An inner housing 16 of a substantially identical configuration as the outer housing 12, but of small dimensions, is disposed within the housing 12 and is preferably constructed of a similar fire and heat resistant material. The outer dimension of the housing 16 is preferably of a size for insertion through the central opening of the flange 14 as will be particularly seen in FIG. 1. At least one of the inner housing 16 is open, and is provided with an outwardly extending flange 18 around the outer periphery thereof for engagement with the flange 14 in the assembled position between the housings 12 and 14. Of course, the flanges 14 and 18 may be secured together in any suitable manner (not shown) in the final assembly of the box 10 to provide a substantially unitary, double walled housing, as will be hereinafter set forth.

A suitable insulation material 20 is interposed between the inner periphery of the housing 12 and the outer periphery of the housing 16 in any suitable or well known manner, and a layer of insulation material 22 is also preferably provided on the inner periphery of the housing 16, as particularly shown in FIG. 1. The insulation material 22 may be secured to the housing 16 in any desired manner, such as by cementing, bonding, or the like, as is well known. The insulation materials 20 and 22 are preferably of any well known, suitable type which is heat and fire resistant whereby the internal chamber 24 of the housing 16 is insulated from the hazards of external heat and fire for protection of any contents such as a box or container 25, disposed in the chamber.

A lid or access door 26 is hingedly secured to the flange 18 in any suitable manner, as shown at 28, whereby the door 26 may be manually moved between open and closed positions against the flange 18 for providing selective access to the chamber 24. The door 26 is preferably constructed from a suitable heat and fire resistant material, such as steel, and is preferably of a substantially open box type configuration with the open side thereof being exposed to the chamber 24. Suitable insulation material 30 is disposed in the inwardly directed portion of the lid 26 and may be secured therein by any suitable means, such as bonding, cementing, or the like. The insulation material 30 is preferably the same as the insulation materials 20 and 22. Thus, when the door 26 is in the closed position, the chamber 24 will be protected against the hazards of external heat and fire.

A pin-lock device generally indicated at 32 cooperates between the double walled housing and the door 25 for securely locking the door in the closed position for security against theft of the contents of the box 10. The pin-lock device 32 comprises a first sleeve member 34 centrally disposed on the outer edge of the door 26 and oppositely disposed from the hinge 28. The central bore 36 of the sleeve 34 is preferably of a substantially square or rectangular cross-sectional configuration for a purpose as will be hereinafter set forth. A pair of spaced generally similar sleeves 38 and 40 are rigidly secured to the flange 18 in any suitable manner, such as by welding, or the like, and are spaced apart in such a manner that the distance between the mutually facing ends of the sleeves is substantially equal to the length of the first sleeve 34, with only sufficient clearance therebetween for permitting the door 26 to be easily moved into and out of engagement with the flange 18. The outer end of each sleeve 38 and 40 is closed but provided with apertures 39 and 41, respectively, for a purpose as will be hereinafter be set forth. The central bores 42 and 44 of the sleeves 38 and 40, respectively, are in substantially axial alignment and are of a square or cross-section configuration complementary to the cross-sectional configuration of the bore 36. When the door 26 is in a closed position against the flange 18, the sleeves, 34, 38 and 40 are disposed in end to end relation whereby the bores 36, 42 and 44 thereof are in substantial axial alignment, as particularly shown in FIG. 6.

A lock pin 46 is provided for the lock-pin device 32 and is of a cross-sectional configuration complementary to the cross-sectional configuration of the bores 36, 42 and 44. The pin 46 is of an outer dimension slightly smaller than the dimensions of the bores in order that the pin may be readily inserted lengthwise through the aligned bores. In addition, the length of the pin 46 is substantially identical with the length of the sleeve 34 for a purpose as will be hereinafter set forth.

A pair of key-pins 48 and 50 are provided for cooperation with the pin 46 to selectively lock and unlock the lock device 32. The key-pin 48 comprises an elongated shaft portion 52 having a suitable stop member 54 at one end thereof for limiting the depth of insertion of the key-pin into one of the bores, as will be hereinafter set forth. The key-pin 50 comprises an elongated shaft portion 56 having a suitable stop member 58 at one end thereof similar to the stop member 54 and for the same purpose. The key-pins 48 and 50 are preferably substantially identical with the exception that the shaft 52 of the key 48 is of a length greater than the length of either of the sleeves 38 and 40, whereas the shaft member 56 of the key-pin 50 is of a length substantially identical with the length of at least one of the sleeves 38 and 40.

Figure 6:
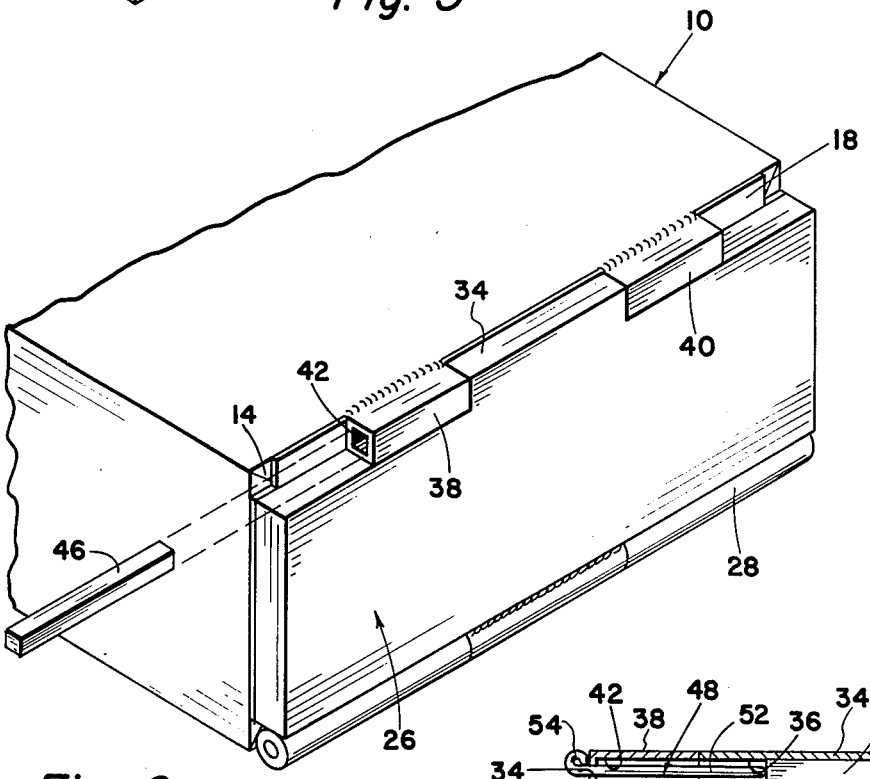
FIG. 6 is a perspective view of the end of the security storage box of FIGS. 1 through 4 with the access door thereon and illustrating the pin-lock device cooperating between the housing and door.
Figure 7:
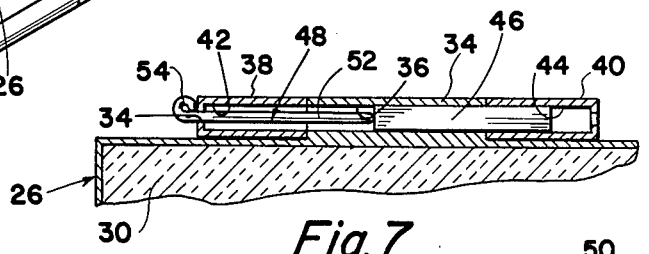
FIG. 7 is a sectional view of the pin-lock device in a locked position between the door and housing.
Figure 8:
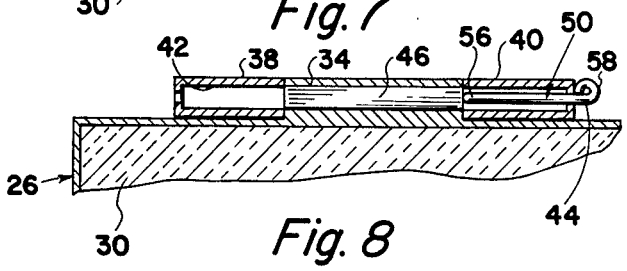
FIG. 8 is a view similar to FIG. 7 and illustrates an unlocked position for the pin-lock device.

When it is desired to lock the door 26 in a closed position against the flange 18 for precluding access to the chamber 24, the door 26 may be manually positioned against the flange in such a manner that the sleeves 34, 36 and 40 are in substantial alignment, as shown in FIG. 6. The pin 46 may then be manually inserted into one of the bores, such as the bore 42 of the sleeve 38. The key-pin having the longest shaft, such as the pin 48, may be placed in end to end engagement with the pin 46, and manually moved in a direction for moving the pin 46 longitudinally within the aligned bores. The pin 48 may be inserted into the bore behind the pin 46 through a sufficient distance to bring the head member 54 into engagement with the outer end of the respective sleeve member, such as the sleeve 38, as particularly shown in FIG. 7. Since the length of the shaft 52 is greater than the length of the sleeve 38, the pin 46 will be over through a distance greater than the length of the sleeve 38, and positioned within a portion of both the sleeve 34 and the sleeve 40. In this manner, the cover 26 is securely locked to the housing for precluding unwanted access to the chamber 24.

In the event an unauthorized person attempts to gain entry into the chamber 24, it is to be noted that the position of the pin 46 is completely hidden by the structure of the device 10, thus rendering it difficult if not impossible to guess at the position of the pin 46 within the bores, and substantially precluding opening of the lock device without the proper key-pin arrangement, as will be hereinafter set forth. In addition, in the event such unauthorized personnel should attempt to gain entry to the chamber 24 by removal of the hinge pin 29 of the hinge apparatus 28, it is to be noted that the cross-sectional configuration of the bores 36, 42 and 44 is square or rectangular, as is the cross-sectional configuration of the pin 46. This configuration precludes pivoting of the cover 26 about the lock device 32, thus precluding unauthorized opening of the box 10.

When the lock 32 is to be unlocked, the key-pin 50 may be inserted into the bore 44 until the outer end of the key-pin 50 engages the end of the pin 46. The key-pin 50 may be pushed through the bore 44 a sufficient distance for bringing the head member 58 into engagement with the outer end of the sleeve 40 as particularly shown in FIG. 8. This will move the pin 46 to a position wherein the pin is contained entirely within the sleever 34, thus releasing the cover 26 from engagement with the housing, and permitting easy opening of the cover by pivoting thereof about the hinge 28.

Figure 9:
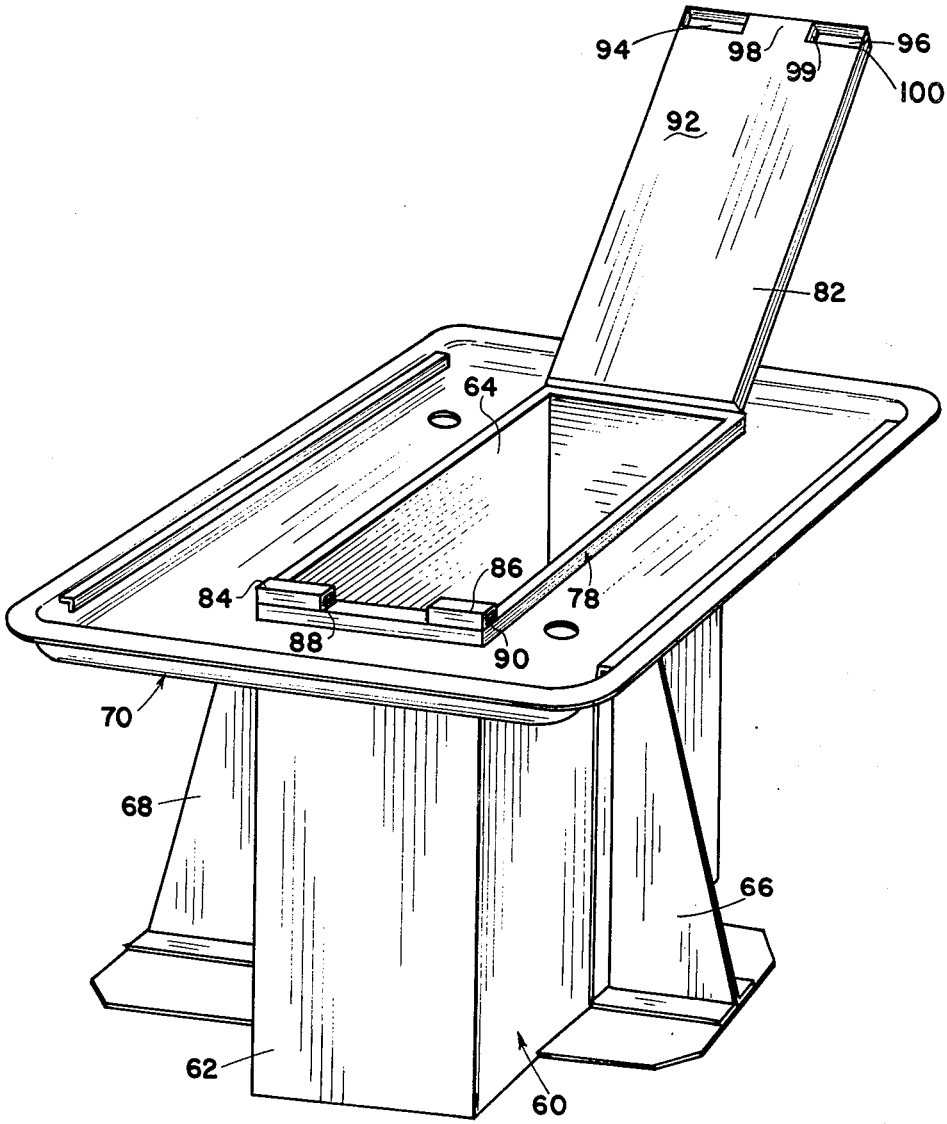
FIG. 9 is a perspective view of a modified security storage box embodying the invention and illustrated particularly for installation in a floor.
Figure 10:
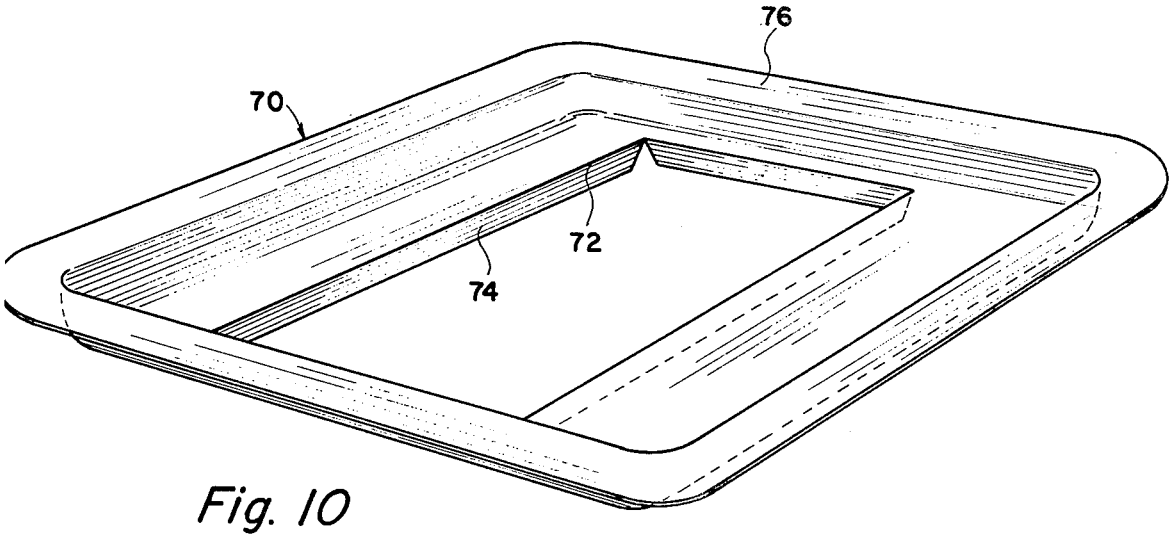
FIG. 10 is a perspective view of an adaptor plate which may be utilized in the installation of the storage box of FIG. 9 in a floor.

Referring now to FIGS. 9 through 13, a modified security storage box is generally indicated at 60 which is similar to the box 101 and comprises a double walled housing 62 having at least one end thereof open as shown at 64. A pair of substantially identical buttresses 66 and 68 are secured to the opposite sides of the housing 62 for strengthening thereof, as particularly shown in FIG. 9. An adapter plate 70 is secured to the outer periphery of the housing 62 in the proximity of the open end 64 thereof and extends outwardly therefrom for facilitating supporting of the housing 62 in a floor, as will be hereinafter set forth. The plate 70 is provided with a centrally disposed rectangular aperture 72 of a size and configuration corresponding to the outer periphery of the housing 62 and a downwardly extending flange 74, as viewed in FIG. 10, is provided around the aperture 72 for disposition against the outer periphery of the housing 62 to facilitate securing of the plate 70 thereto. In addition, the outer periphery of the plate 70 is raised with respect to the central portion thereof, and is provided with an outwardly extending flange 76 extending therearound for facilitating the installation of the security box 60 in a floor as will be hereinafter set forth.

A substantially rectangular frame 78 is centrally disposed on the plate 70 and in substantial alignment with the aperture 72 as will be seen in FIG. 9. The frame 78 is provided with portions of a hinge, as indicated at 80, on one end thereof for cooperation with the complementary portions thereof (not shown) provided on a cover member 82 for hingedly securing the cover 82 to the opening 64, as is well known. The opposite end of the frame 82 is provided with a pair of spaced sleeves 84 and 86 similar to the sleeves 38 and 40. Each of the sleeves 84 and 86 is provided with a bore 88 and 90, respectively, extending longitudinally therethrough for the same purpose as the bores 42 and 44. The inwardly directed surface 92 of the cover 82 is provided with a pair of recesses 94 and 96 adapted for receiving the sleeves 84 and 86 therein in the closed position of the cover 82. A lug member 98 is interposed between the recesses 94 and 96 and is provided with a bore 99 extending longitudinally therethrough in substantial alignment with the bores 88 and 90 when the cover 82 is closed. The cross-sectional configuration of the bore of the lug 98 is square or rectangular corresponding to the bore 36, and for the same purpose. A suitable aperture 100 is provided in the cover 82 in communication with each of the recesses 94 and 96 and the apertures 100 are for the same purpose as the apertures 39 and 41. A pin 46 is utilized in combination with the bores 88, 90 and 99 and key-pins 48 and 50 in the same manner as hereinbefore set forth to provide alternate locked and unlocked positions of the cover 82 with respect to the housing 62.

Figure 14:
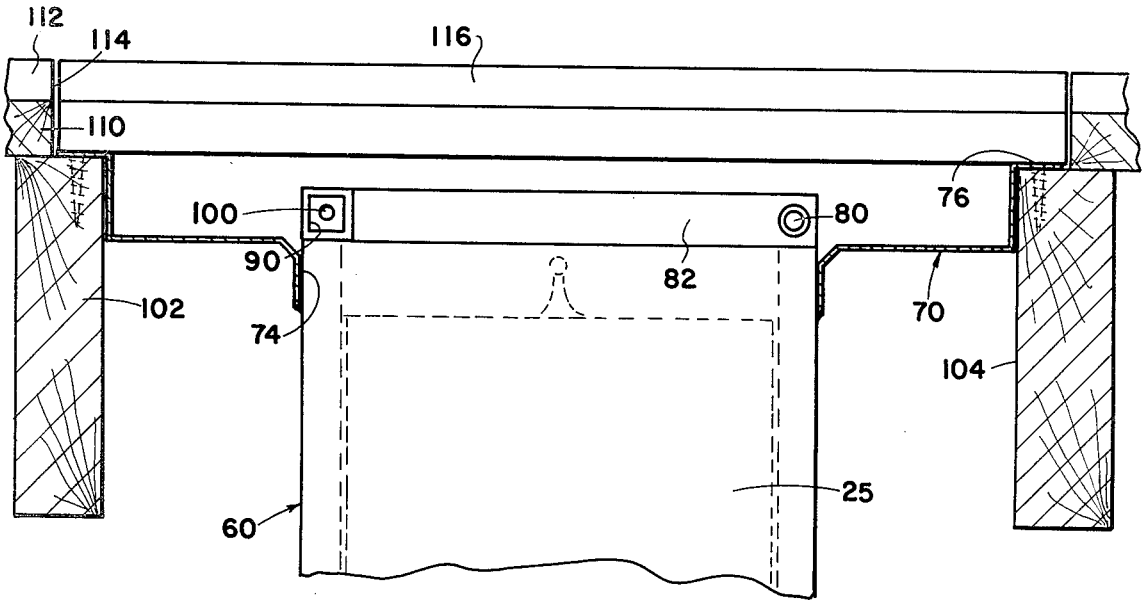
FIG. 14 is an end elevational view, partly in section, of the upper portion of a security storage box embodying the invention and installed between a pair of adjacent floor joints.
Figure 15:
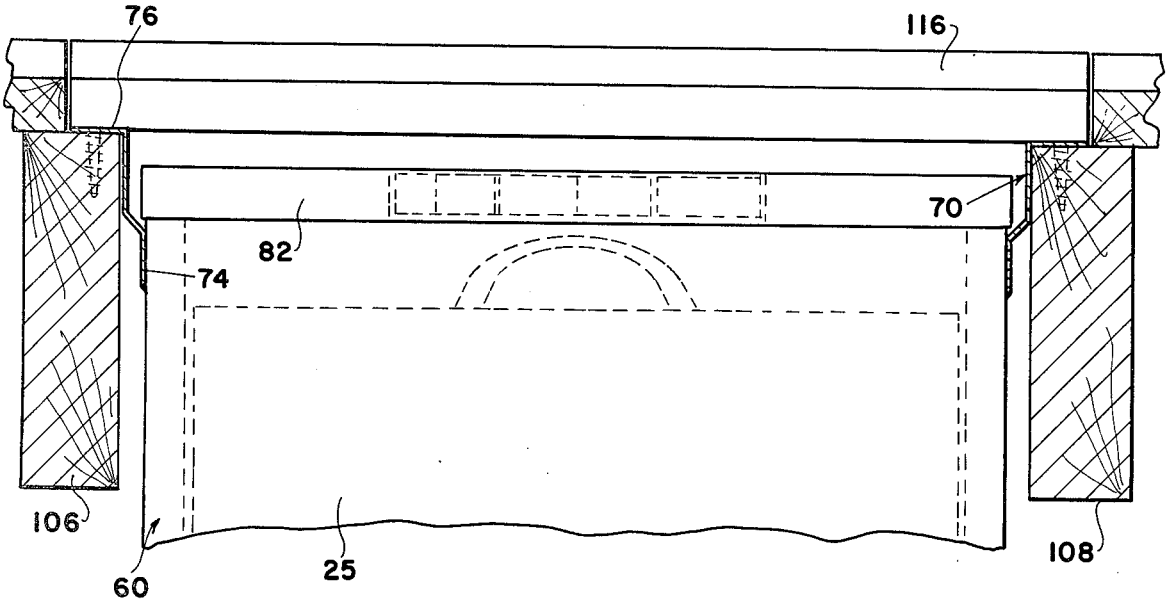
FIG. 15 is a side elevational view, partly in section, of the security storage box installation shown in FIG. 14.

The security storage box 60 is particularly adapted to be installed between a first pair of floor joists 102 and 104 and a second pair of floor joists 106 and 108 disposed perpendicular to the first joists, as shown in FIGS. 14 and 15. The adapter plate 70 may be disposed between the joists 102 and 104, and 106 and 108 in such a manner that the flange 76 is supported by the upper edges of the joists. The usual sub-flooring 110 and flooring 112 may be provided with an aperture 114 in alignment with the plate 70 for ultimate access thereto, and of course, the aperture 114 may be removably filed with a suitable plug or block member 116, which is preferably designed in accordance with the overall design of the floor 112 in order that the block 116 will be substantially invisible, or undetectable. Of course, when access to the box 60 is required, the block 116 may be manually removed from position, and the proper key-pin may be utilized for unlocking the cover and permitting opening thereof for access to the interior of the box 60 as hereinbefore set forth.

Figure 11:
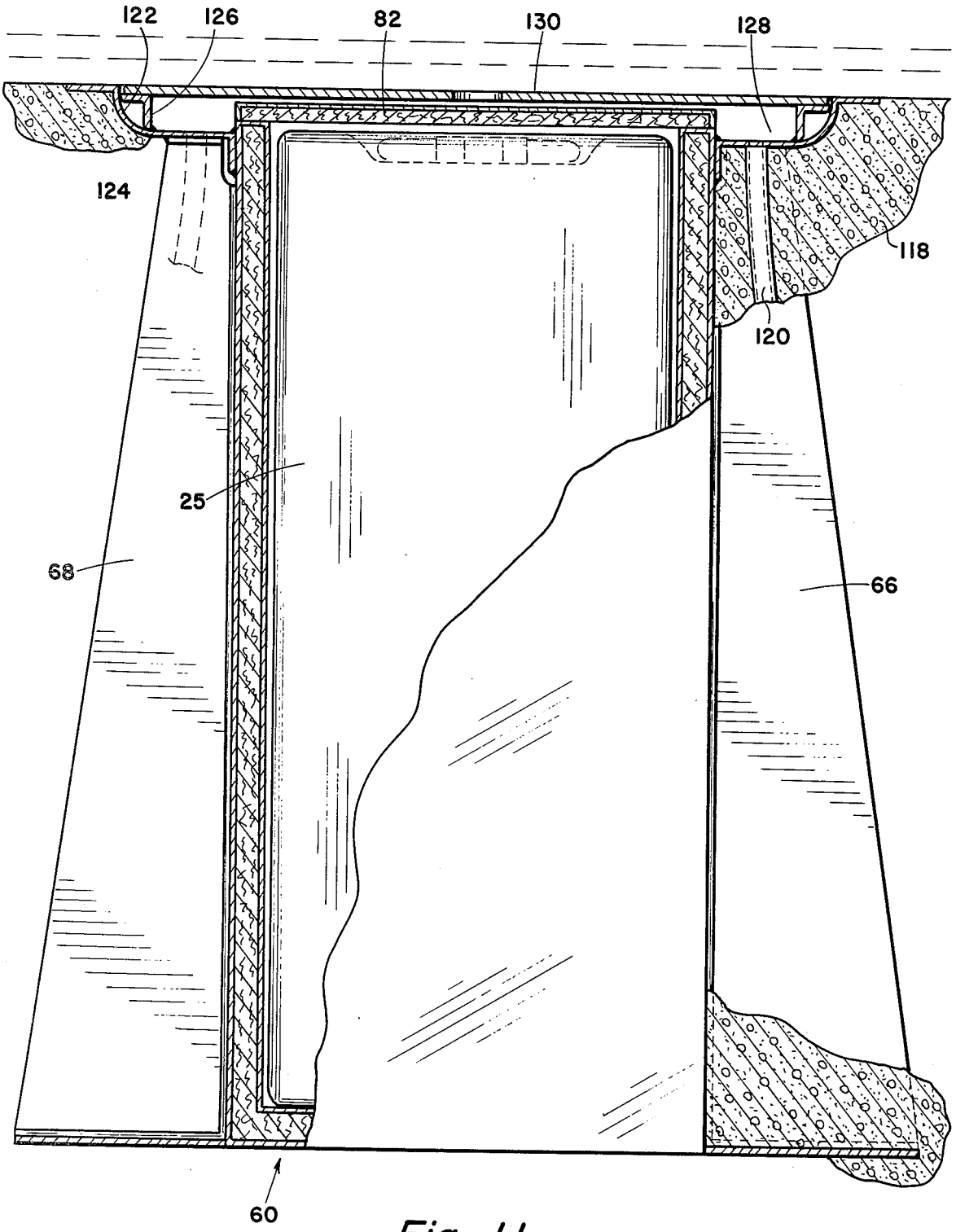
FIG. 11 is an elevational view, partly in section, illustrating a security storage box embodying the invention and installed in concrete.
Figure 12:
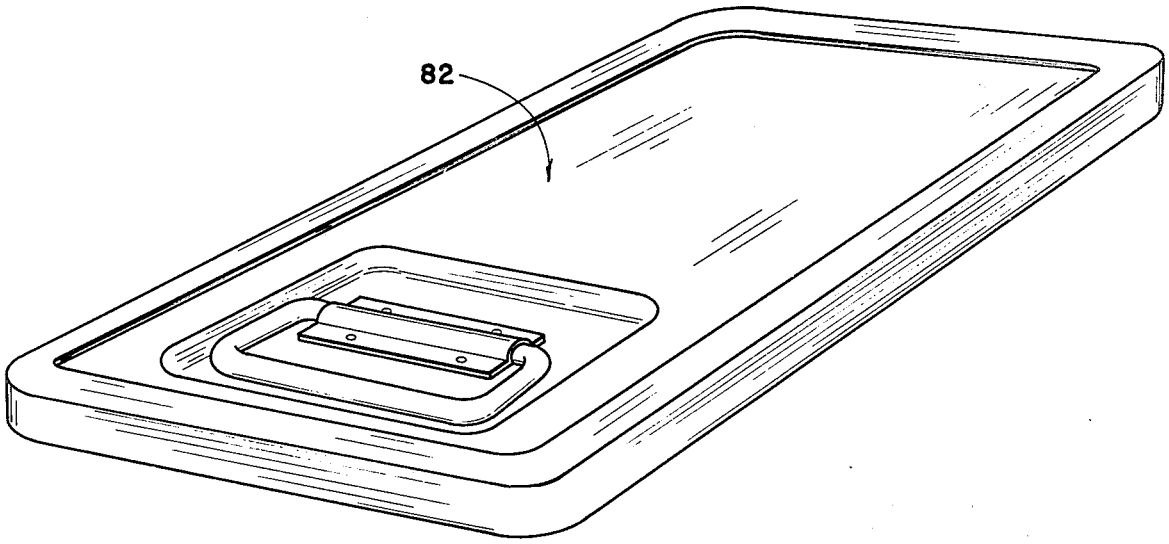
FIG. 12 is a perspective view of a cover member utilized on a security box embodying the invention.
Figure 13:
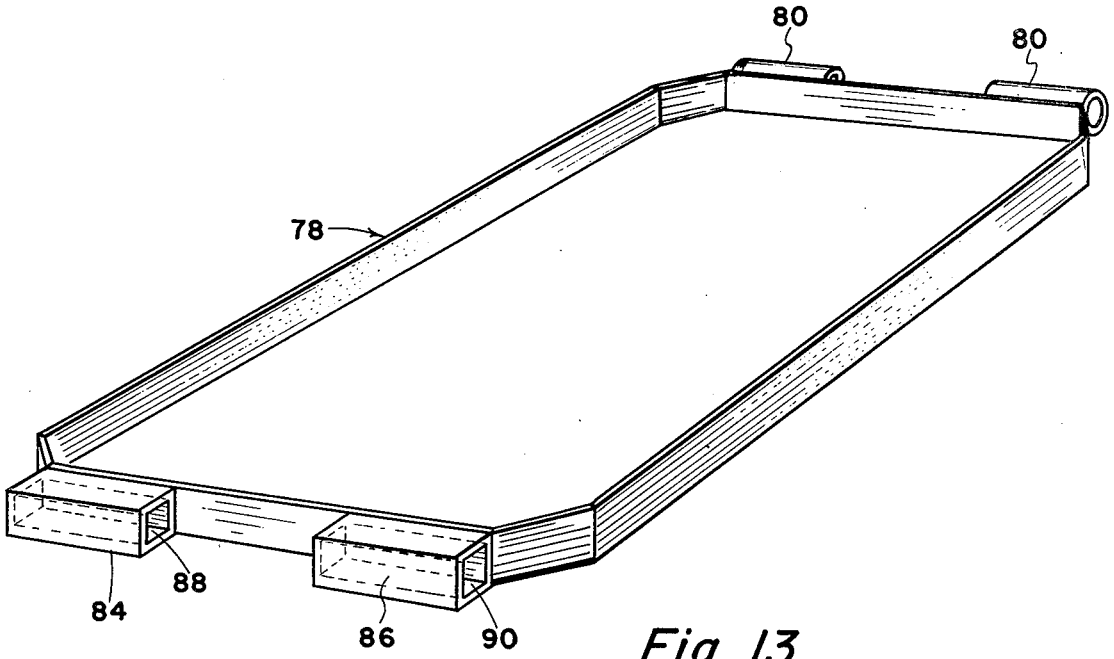
FIG. 13 is a perspective view of a locking frame member which may be utilized with the cover shown in FIG. 12.

Referring now to FIG. 11, the box 60 is illustrated as installed in a concrete floor, or the like, as indicated at 118. In this type installation, it may be desirable to provide tubing 120, or other suitable passageway means extending from the upper surface of the plate 70 to an exhaust area therebelow for permitting the drainage of any moisture which may collect on the plate 70. In addition, it may not be necessary to provide the insulation between the walls of the housing 60 in the event of the installation thereof in concrete. However, the insulation of the cover member 82 will be preferred, regardless of the installation site of the box 60.

In the concrete installation shown in FIG. 11, it may be desirable to provide a suitable recess 122 surrounding an opening 124 whereby the security storage box 60 may be installed in the opening 124 with the flange 76 of the plate 70 being supported by the recess 122. A pair of suitable flange members 126 and 128 may be secured to the upper surface of the plate 70 along the opposite side edges thereof for supporting a floor plate 130 which may be removably disposed over the recess 122 for obscuring the presence of the opening 124 and box 60 contained therein.

From the foregoing it will be apparent that the present invention provides a novel security storage box particularly designed and constructed for protection of the interior thereof from the hazards of heat and fire and for protection of the contents thereof from theft. The novel box comprises a double walled housing having suitable insulation therein for protection against fire and heat, and a novel key-pin type locking device is provided for securely locking the box against unauthorized entry or access to the contents thereof.

What is claimed is:

1. A security storage box comprising housing means having at least one side thereof open for providing selective access to the interior thereof, an insulated cover member secured to the housing adjacent said open side and movable between alternate opened and closed positions thereagainst, a locking pin, cooperating apertured sleeve members disposed on the cover member and housing for slidably receiving the locking pin therein, said sleeves being disposed in substantial axial alignment in the closed position of the cover against the open side of the housing whereby the locking pin may be moved longitudinally through the aligned apertures, selective key-pin members adapted for manual insertion within the apertures for controlled movement of the locking pin therein to provide alternate locked and unlocked positions between the sleeves for selective locking and unlocking of the cover member against the open side of the housing, said apertured sleeves comprising a first pair of spaced apertured sleeves, a third sleeve adapted for positioning between the spaced apertured sleeves and in substantially axial alignment therewith in the closed position of the cover member, and wherein the locking pin member is of a length substantially equal to the third sleeve whereby positioning of the locking pin entirely within the third sleeve provides said unlocked position and positioning of the locking pin partially in said third sleeve provides said locked position.

2. A security storage box as set forth in claim 1 wherein the housing means comprises an outer housing, an inner housing concentrically arranged within the outer housing, and insulating material interposed between the inner and outer housings for protection of the interior of the storage box from external heat and fire.

3. A security storage box as set forth in claim 1 wherein at least one of the key-pins is of a length substantially equal to one of said pairs of spaced sleeves.

4. A security storage box as set forth in claim 1 wherein the apertures of the sleeves are of a substantially rectangular cross-sectional configuration, and the cross-sectional configuration of the lock pin is substantially rectangular complementary to the apertures.

5. A security storage box as set forth in claim 1 and including oppositely disposed outwardly extending buttress members secured to the outer periphery of the housing for strengthening thereof.

6. A security storage box as set forth in claim 5 and including an adapter plate secured around the outer periphery of the housing in the proximity of the open end thereof for facilitating installation of the box in a concealed place.

7. A security storage box as set forth in claim 6 wherein said adapter plate comprises a flange extending around the outer periphery thereof for facilitating supporting of the storage box in said concealed place, and a centrally disposed aperture for substantial alignment with the open side of the housing for facilitating access to the interior of the housing.

8. A security storage box as set forth in claim 7 and including drain outlet means provided in the adapter plate for discharge of any accumulation of liquid on the plate.

9. A security storage box as set forth in claim 1 wherein said housing means comprises an outer housing having peripheral flange means extending outwardly therefrom in the proximity of one end thereof, a hanger apparatus for supporting the storage box in a concealed position and comprising support flange means having a centrally disposed opening corresponding in size and configuration with the cross-sectional configuration of the outer periphery of the housing, a trough member interposed between the central opening and the outer periphery of the support flange means and having the outer periphery thereof spaced inwardly from the outer periphery of the support flange means, said trough member having the inner edges thereof defining a plane which is in spaced relation with respect to the plane of the outer peripheral portion of the support flange means for receiving the peripheral flange means of the housing thereon in a manner for supporting the housing in a recessed position with respect to the outer peripheral portion of the support flange means.

10. A security storage box as set forth in claim 9 wherein the trough means is of an arcuate cross-sectional configuration.

11. A security storage box comprising a housing having at least one open side for facilitating access to the interior thereof, a cover hingedly secured to the housing in the proximity of the open side thereof and movable between open and closed positions against said open side, a pair of spaced sleeves and cooperating third sleeve adapted for selective positioning between the pair of spaced sleeves carried by the cover and housing, said pair of spaced sleeves and third sleeve being positioned in substantial alignment in the closed position of the cover, each of said sleeves being provided with a bore extending longitudinally therethrough for slidably receiving a lock pin therein, each of said bores being of a substantially rectangular cross-sectional configuration, said lock pin being of a rectangular cross-sectional configuration complementary to the bores, key-pin members engagable with the lock pin disposed within the bores for selectively moving the lock pin therein between locked and unlocked positions for the sleeves whereby said cover may be selectively locked and unlocked in the closed position thereof, and wherein the lock pin is of a length substantially equal to the length of said third sleeve member whereby positioning of the lock pin entirely within the third sleeve will provide said unlocked position, and positioning of the lock pin partially in said third sleeve will provide said locked position.

12. A security storage box as set forth in claim 11 wherein the key-pin members each comprise a shaft member adapted for engagement with the lock pin disposed within the bores, and a head member on one end of the shaft for limiting the depth of insertion of the key-pin within the bore during a locking or unlocking operation.

13. A security storage box as set forth in claim 12 wherein the shaft of at least one of the key-pin members is at least as long as the length of one of said pairs of spaced sleeve members for facilitating positioning of the lock pin within the aligned bores during locking and unlocking of the cover to the housing.

* * * * *